US011244589B1

(12) United States Patent
Larry et al.

(10) Patent No.: US 11,244,589 B1
(45) Date of Patent: Feb. 8, 2022

(54) EXTERIOR FACING MULTILAYER DISPLAY SYSTEMS AND METHODS OF USE

(71) Applicant: Ford Global Technologies, LLC, Dearborn, MI (US)

(72) Inventors: Mark Larry, Macomb, MI (US); Biaohe Guo, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/085,689

(22) Filed: Oct. 30, 2020

(51) Int. Cl.
*G09G 5/00* (2006.01)
*G09G 3/20* (2006.01)

(52) U.S. Cl.
CPC ..... *G09G 3/20* (2013.01); *G09G 2330/021* (2013.01); *G09G 2380/10* (2013.01)

(58) Field of Classification Search
CPC .. G09G 3/20; G09G 3/30; G09G 3/32; G09G 3/3208; G09G 3/36; G09G 2330/021; G09G 2380/10
See application file for complete search history.

(56) References Cited

U.S. PATENT DOCUMENTS 7,164,117 B2 * 1/2007 Breed ..... B60R 21/01516 250/208.1
10,375,365 B2 * 8/2019 Perdices-Gonzalez ..... G09G 3/348
10,453,371 B2 * 10/2019 Perdices-Gonzalez ..... G09G 3/32
10,554,962 B2 * 2/2020 Perdices-Gonzalez ..... G09G 3/003
2006/0208169 A1 * 9/2006 Breed ..... G06K 9/00624 250/221
2017/0309215 A1 * 10/2017 Perdices-Gonzalez ..... G09G 3/2003

* cited by examiner

*Primary Examiner* — Vijay Shankar
(74) *Attorney, Agent, or Firm* — Frank Lollo; Eversheds Sutherland (US) LLP

(57) ABSTRACT

Exterior facing, multilayer display systems and methods of use are provided herein. An example method includes determining an amount of power for a multilayer display, the multilayer display having a first layer comprising a transparent display unit and a second layer comprising a reflective display unit, the second layer being bonded to the first layer, selecting the transparent display unit when the amount of the power is above a threshold amount, determining that amount of the power is above a threshold amount is below the threshold amount, and selecting the reflective display unit when the power is below the threshold amount.

20 Claims, 3 Drawing Sheets

EXTERIOR FACING MULTILAYER DISPLAY SYSTEMS AND METHODS OF USE

TECHNICAL FIELD

The present disclosure relates to multilayer display systems for vehicles that can be used in both powered and low/no power conditions.

BACKGROUND

Vehicles often include visible exterior signage, such as painted characters or stickers, to convey company-related information or a message to viewers. In some instances, these types of visible exterior signage may not be readily reconfigurable, can be subject to damage, and may need to be physically replaced from time to time. Some vehicles include LED (Light Emitting Diode) display systems on exterior body panels. However, these LED displays consume power and typically do not work when the vehicle is powered down. Some vehicles may include an exterior facing LCD (Liquid Crystal Display) for advertising, but LCDs also typically do not work when the vehicle is powered down.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Generally, the present disclosure pertains to display systems, such as multilayer displays that can be used in vehicles. These multilayer displays may include a first layer comprising a transparent display unit and a second layer comprising a reflective display. The layers can be controlled independently based on power availability. For example, when vehicle power is available, the transparent display unit can be used. When the vehicle power is low or unavailable, the reflective display unit can be used.

A multilayer display can be mounted to a vehicle surface (such as an exterior surface) and used to display signage or messaging, such as advertising and/or branding. In general, the transparent display unit can be utilized as a standard display for most conditions, such as when the vehicle is powered on, and the reflective display unit can be used when the vehicle is powered down. When power is available, the transparent display unit may be active, and the reflective display unit may be deactivated or displaying a dark background. The dark background provided by the reflective display unit may improve the contrast for content display on the transparent display unit. In a low/no power availability mode, the transparent display can be turned off, while the reflective display unit displays content. The reflective display unit requires power to change content, but not to hold and display content. In some instances, the content displayed by the reflective display unit may mirror the content displayed by the transparent display unit, while in other instances, the content displayed by each display unit can be unique. The multilayer display can be automatically controlled using a display control unit that communicates with a vehicle platform that delivers power to the multilayer display.

Illustrative Embodiments

Figure 1:
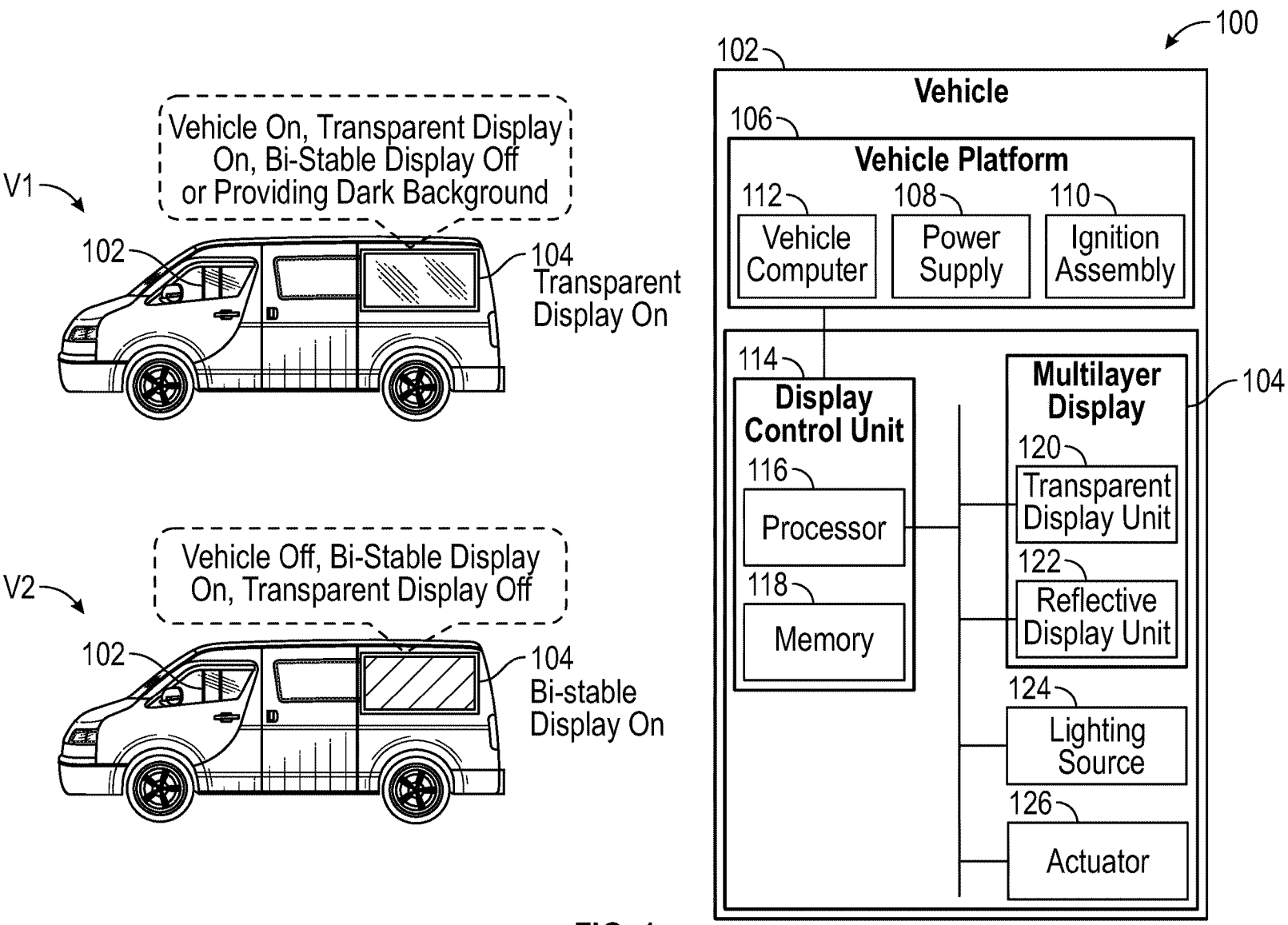
FIG. 1 depicts an illustrative architecture in which techniques and structures for providing the systems and methods disclosed herein may be implemented.

Turning now to the drawings, FIG. 1 depicts an illustrative architecture or illustrative architecture 100 in which techniques and structures of the present disclosure may be implemented. The architecture 100 includes a vehicle 102 having a multilayer display 104. The multilayer display 104 can be mounted to an exterior surface of the vehicle 102, such as a body panel of the vehicle 102. The multilayer display 104 can be located on any surface of the vehicle 102. While one particular type of vehicle is displayed, the multilayer display 104 can be utilized in combination with any type of vehicle desired for any purpose. Moreover, the multilayer display 104 can be mounted or coupled to a fixed location, such as a building or other structure.

The vehicle 102 can include a vehicle platform 106, which generally comprises standard vehicle components that may include a power supply 108 (e.g., battery or other power system component, such as an alternator), ignition assembly 110, and/or vehicle computer 112. In general, each of these components can be evaluated or provide information that is indicative of when power from the power supply 108 is available for use by other vehicle systems, such as the multilayer display 104 and/or a display control unit 114 that is used to control operations of the multilayer display 104.

The display control unit 114 comprises a processor 116 and memory 118. The memory stores executable instructions. The processor 116 can execute the instructions stored in memory 118 to provide the multilayer display control functions disclosed herein. When referring to operations performed by the display control unit 114, it will be understood that this includes execution of instructions stored in the memory 118 by the processor 116.

The display control unit 114 can be configured to determine when power is available or unavailable from the vehicle platform 106. The display control unit 114 can determine when the power supply 108, such as a battery or alternator, are providing power that can be used by vehicle systems, such as the display control unit 114. The display control unit 114 can determine when power is available based on signals received from the vehicle computer 112. For example, the display control unit 114 can query the vehicle computer 112 for an engine or ignition status to determine if power is being generated or if the ignition assembly 110 is in a run state. The display control unit 114 can also be configured to determine when the ignition system was in an on or off state. The display control unit 114 can also determine if an alternator of the vehicle 102 is running or not, which may be indicative of the vehicle 102 running.

The display control unit 114 can determine if the power available from the vehicle platform 106 is above or below a power threshold. For example, if the vehicle 102 is in an accessory mode, the display control unit 114 can determine that the power available from the vehicle platform 106 is below a power threshold and may not be sufficient to power the display control unit 114. An accessory mode of a vehicle can be used to allow a minimum amount of vehicle components to operate, such as lights and radio. This state would be generally referred to as a low power state for the vehicle, as opposed to a high or full power state when the vehicle engine is running and the alternator or other similar vehicle system is active. Another low power state could include instances where the vehicle computer or a related system of the vehicle 102 causes the engine and related systems to stop, such as with an automatic stop/start feature.

When the vehicle is determined to be in a running state (such as when the ignition is on), the display control unit 114 can further determine if the power available from the vehicle platform 106 is above a power threshold. The power threshold can be set at any desired level or amount and may vary based on the operational characteristics of both the vehicle 102 and the display control unit 114. For example, the power needed to run one multilayer display may be greater than the power required to run a different multilayer display. Moreover, a first type of vehicle may produce more available power to run ancillary systems than another vehicle. The display control unit 114 can, in some instances, determine if power is available or not, without regard to a power threshold. In sum, the use of a power threshold allows for determining when power available from the vehicle platform 106 is not available, low, or fully available.

A selected state of the multilayer display 104 can be based on the power status determined from the vehicle platform 106. When power is available, the display control unit 114 can be configured to select a transparent display unit 120 of the multilayer display 104 for operation. The transparent display unit 120 can be selected from any of an Organic Light Emitting Diode (OLED) display, which are capable of approximately 40% transparency, a Liquid Crystal Display (LCD), which are capable of approximately 80% transparency, a Micro-LED display, which are capable of approximately 60% transparency, and/or a Quantum Dot LED display—just to name a few. The transparent display unit 120 may be any suitable display unit.

When the power is low or not available, the display control unit 114 can be configured to select a reflective display unit 122 of the multilayer display 104 for operation. The reflective display unit 122 can include a bi-stable display. A bi-stable display is a display technology that only requires power to change images but does not require power to maintain images. This means the display can still keep and display images when there is no power supply. An example of the bi-stable display technology is the electronic ink (E-ink) display technology. Another example is the bi-stable LCD technology. Bi-stable displays do not require power to illuminate content on display but instead utilize ambient light for illumination of content. The reflective display unit 122 can also be transparent to at least some degree.

In an example use case, the display control unit 114 can automatically select the transparent display unit 120 when power to the multilayer display 104 is above a threshold amount. The display control unit 114 can automatically select the reflective display unit 122 when the power to the multilayer display 104 is below the threshold amount. For example, the display control unit 114 can determine if an input voltage/current to the multilayer display 104 is low or meets or exceeds a threshold amount of power. The threshold amount of power can include a power level sufficient to run the multilayer display 104. Thus, the display control unit 114 store information that is indicative of the power level needed to run the multilayer display 104, which specifically relates to the power needed for the transparent display unit 120. Again, no power is needed to run the reflective display unit 122. That is, no power is needed for content to be displayed on the reflective display unit 122. Ambient light illuminates the content of the reflective display unit 122. The reflective display unit 122 can use power when changing content displayed on the reflective display unit 122.

In another use case, the display control unit 114 can automatically select the transparent display unit 120 when the display control unit 114 determines that the ignition assembly or the vehicle controller indicates that the vehicle is in a key on position. The display control unit 114 can automatically select the reflective display unit 122 when the display control unit 114 determines that the ignition assembly or the vehicle controller indicates that the vehicle is in a key off position.

When the transparent display unit 120 has been selected for use, the display control unit 114 can cause the reflective display unit 122 to display a dark background. Due to the placement of the reflective display unit 122 behind the transparent display unit 120 (see FIG. 2), the dark background of the reflective display unit 122 adds additional contrast for the content displayed on the transparent display unit 120. In FIG. 1, in a first view V1, the multilayer display 104 illustrates a first content set using the transparent display unit 120. The vehicle has been turned on to provide power to the multilayer display 104. The transparent display unit 120 is selected and active, while the reflective display unit 122 is off or providing a dark background. The first view V1 illustrates an example of how the multilayer display 104 is integrated with a vehicle. The multilayer display 104 is designed to be put outside the vehicle body panel with the transparent display unit facing outwardly. In some instances, all driving electronics and wires may be hidden inside the vehicle body panel or an enclosure around the multilayer display 104.

In a second view V2, the multilayer display 104 illustrates a first content set using the reflective display unit 122. Again, in first view V1, the reflective display unit 122 can be set to display a dark background. The second view V2 illustrates another use case where the transparent display unit is off (and transparent), while the bi-stable display unit is on and showing images or other content. This use case occurs when the vehicle is off (power not being provided by a vehicle platform), but there is a need to display images on the multilayer display 104. In this case, the reflective display unit 122 can provide content but the content cannot be changed. Again, the reflective display unit 122 is a reflective display technology. Thus, the vehicle should be parked near an ambient light source during night so that the content displayed on the reflective display unit 122 can be viewed. Alternatively, a lighting source can be used, as described in greater detail below.

The multilayer display 104 can be manually controlled using an actuator 126, such as a button or switch. A user can utilize the actuator 126 to toggle between the transparent display unit 120 and the reflective display unit 122. The actuator 126 could be placed inside the vehicle 102 so that the driver can readily toggle the multilayer display 104 upon entry and/or exit. The actuator 126 could be housed in an enclosure surrounding the multilayer display 104.

The vehicle 102 can incorporate a lighting source 124 that is positioned near or around the multilayer display 104 to illuminate the reflective display unit 122. The lighting source 124 can include an LED light or other similar low-power light that can be powered using power from the vehicle or a dedicated power source associated with the lighting source 124.

Figure 2:
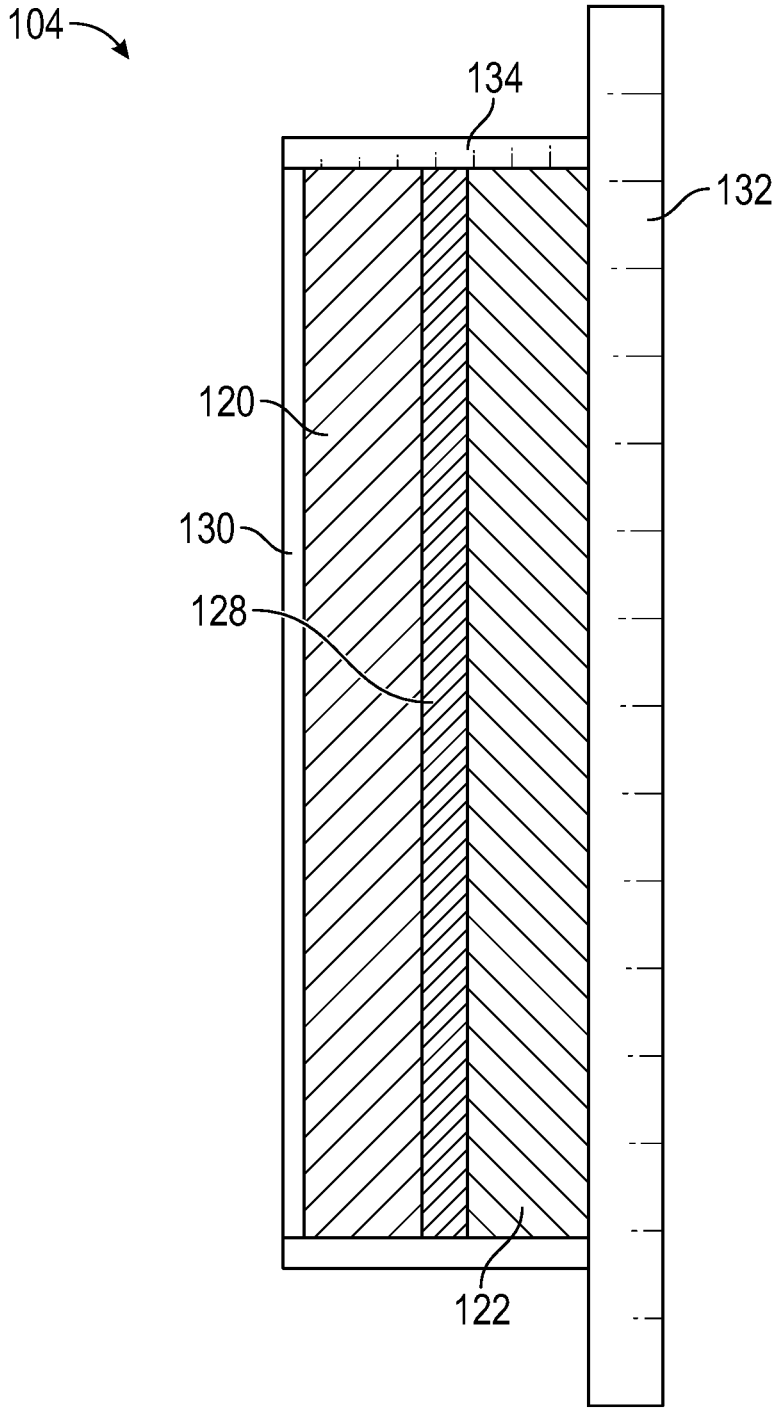
FIG. 2 is a cross-sectional view of an example multilayer display for use in accordance with the present disclosure.

FIG. 2 illustrates a cross-sectional view of at least a portion of the multilayer display 104. The multilayer display 104 includes the transparent display unit 120 and the reflective display unit 122, which are joined together by a bonding layer 128. In some configurations, the reflective display unit 122 is positioned behind the transparent display unit 120. In another example process, a transparent display unit can be laminated to a bi-stable display unit. The two units are formed separately on their own substrates, either rigid or flexible, using their own manufacturing technologies. The two units can then be laminated together using optical bonding technologies with the transparent display unit on top and the bi-stable display at the bottom.

The bonding layer 128 can include an adhesive or other similar material that can bond the transparent display unit 120 to the reflective display unit 122. The bonding layer 128 is created from a transparent or partially transparent material, which allows the reflective display unit 122 to be seen through the transparent display unit 120. A cover layer 130 can be applied to an outermost surface of the transparent display unit 120 to protect the transparent display unit 120. In other instances, the two units may not be bonded. Rather, the two units may be juxtaposed/disposed adjacent and encased in a housing.

The multilayer display 104 can be mounted to a vehicle surface 132. The multilayer display 104 can also be mounted flush or inset relative to the vehicle surface 132. The multilayer display 104 can be coupled to the vehicle surface 132 using any desired attachment means. For example, an enclosure 134 that surrounds the multilayer display 104 can be mounted to the vehicle surface 132 using fasteners.

Figure 3:
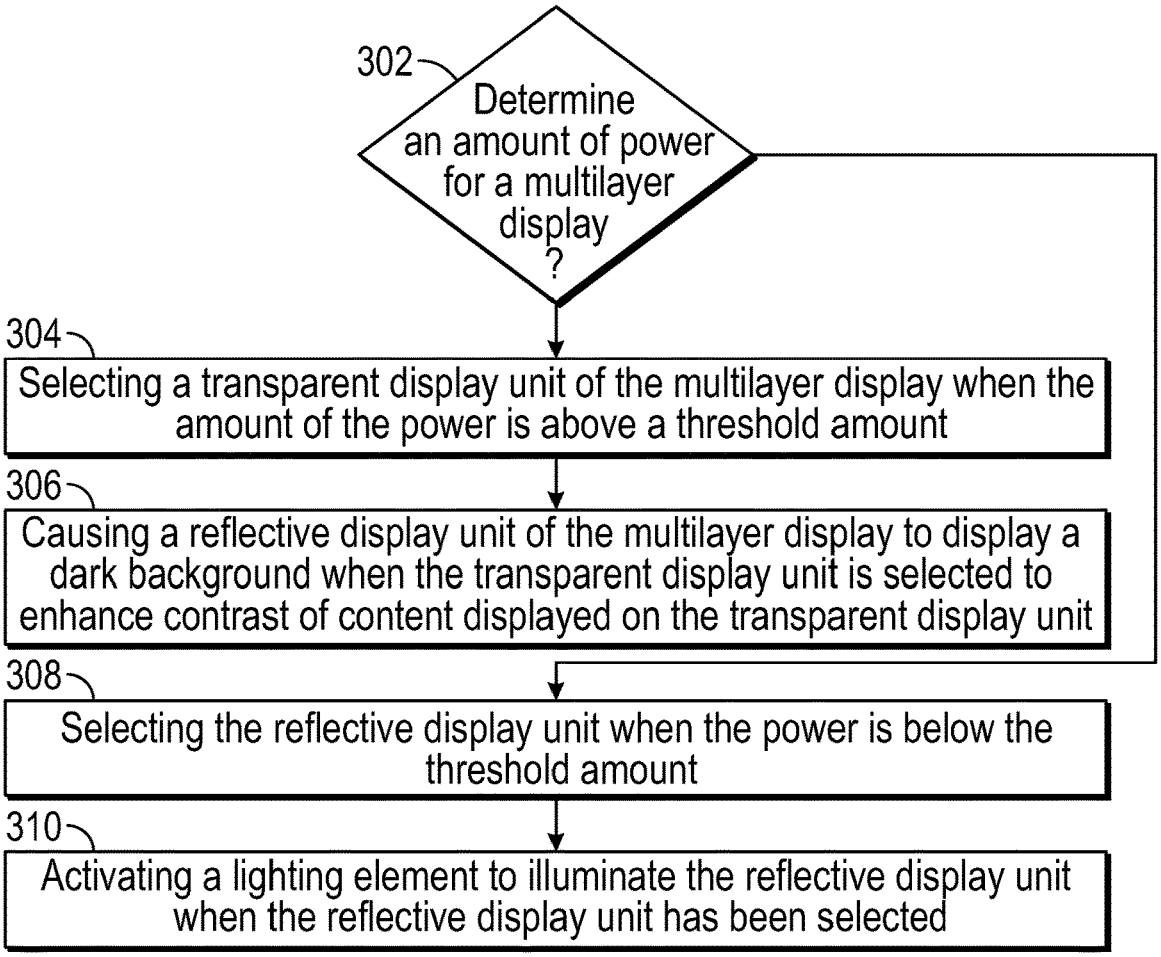
FIG. 3 is a flowchart of an example method for controlling a multilayer display in accordance with the present disclosure.

FIG. 3 is a flowchart of an example method of the present disclosure. The method includes a step 302 of determining an amount of power for a multilayer display. This process can include determining if any power is available, and/or if a power that is available is sufficient to power the multilayer display.

Next, the method can include a step 304 of selecting a transparent display unit of the multilayer display when the amount of the power is above a threshold amount. For example, when the power available to the multilayer display is above a power level that is needed to operate the multilayer display, the transparent display unit can be selected. An optional method step 306 can include causing a reflective display unit of the multilayer display to display a dark background when the transparent display unit is selected to enhance contrast of content displayed on the transparent display unit.

Alternatively, it may be determined in step 302 that the amount of the power available to the multilayer display is below the threshold amount. For example, it can be determined that the power available to the multilayer display is insufficient to power the transparent display unit. When the power is below the threshold amount, the method can include a step 308 of selecting the reflective display unit when the power is below the threshold amount.

The method can include an optional step 310 of activating a lighting element to illuminate the reflective display unit when the reflective display unit has been selected. The lighting element can be internally powered or can obtain power from a vehicle system.

Figure 4:
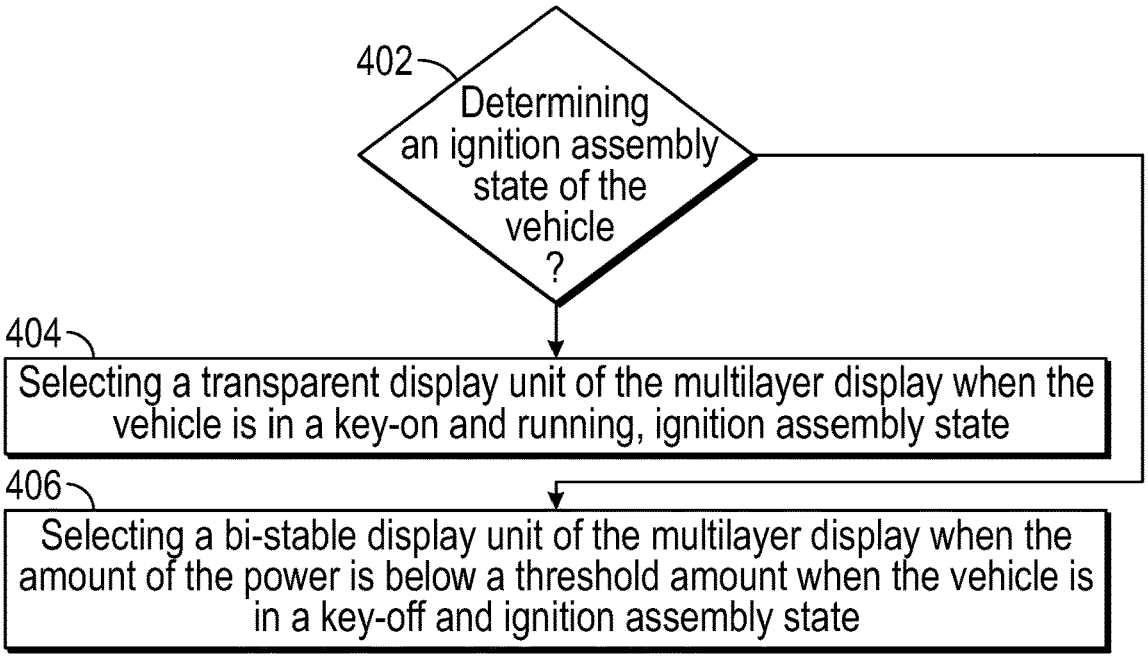
FIG. 4 is a flowchart of another example method for controlling a multilayer display in accordance with the present disclosure.

FIG. 4 is a flowchart of another example method. The method can include an initial step 402 of determining an ignition assembly state of the vehicle. For example, it can be determined if the vehicle is in a key-on and running, ignition assembly state, or a key-off ignition assembly state. The method can include a step 404 of selecting a transparent display unit of the multilayer display when the vehicle is in a key-on and running, ignition assembly state. The method can include a step 406 of selecting a bi-stable display unit of the multilayer display when the amount of the power is below a threshold amount when the vehicle is in a key-off and ignition assembly state. Again, rather than determining an ignition assembly state, the choice of display unit can be based on determining a power input to the multilayer display and/or an output of an alternator of the vehicle, as other examples. The optional steps disclosed above in FIG. 3 can also be applied to the method of FIG. 4.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, while embodiments of the disclosure have been described with respect to specific configurations, numerous other configurations are within the scope of this disclosure. Still further, while embodiments of the disclosure have been described with respect to specific types or configurations of systems and devices, numerous other types and configurations are within the scope of this disclosure.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments.

Computer-executable instructions comprise, for example, instructions and data which, when executed at a processor, cause a general purpose computer, special purpose computer, or special purpose processing device to perform a certain function or group of functions. The computer-executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

At least some embodiments of the present disclosure have been directed to computer program products comprising such logic (e.g., in the form of software) stored on any computer-usable medium. Such software, when executed in one or more data processing devices, causes a device to operate as described herein.

That which is claimed is:

1. A vehicle, comprising:

a multilayer display comprising a first layer comprising a transparent display unit, and a second layer comprising a reflective display unit, wherein the second layer is bonded to the first layer, and wherein the multilayer display is mounted to the vehicle in such a way that the second layer is located between the first layer and a surface of the vehicle;

a vehicle platform configured to provide power to the multilayer display; and a display control unit coupled to the vehicle platform, the display control unit configured to:

select the transparent display unit based on a determination that the vehicle is in a key on position, and select the reflective display unit based on a determination that the vehicle is in an accessory mode or a determination that the vehicle is turned off.

2. The vehicle according to claim 1, further comprising a cover layer applied to the first layer.

3. The vehicle according to claim 1, wherein the display control unit is configured to cause the reflective display unit to display a dark background when the transparent display unit is selected.

4. The vehicle according to claim 1, wherein the display control unit is configured to activate a lighting element on the vehicle to illuminate the reflective display unit when the reflective display unit has been selected.

5. The vehicle according to claim 1, further comprising an actuator, wherein the actuator is utilized to toggle between selection of the transparent display unit and the reflective display unit.

6. The vehicle according to claim 1, wherein the transparent display unit comprises any of an Organic Light Emitting Diode (OLED) display, a Liquid Crystal Display (LCD), a Micro-LED display, and/or a Quantum Dot LED display.

7. The vehicle according to claim 1, wherein the reflective display unit is a bi-stable display.

8. The vehicle according to claim 7, wherein the bi-stable display is an electronic ink (E-ink) display or a bi-stable LCD.

9. A multilayer display associated with a vehicle, comprising:

a first layer comprising a transparent display unit;

a second layer comprising a reflective display unit, the second layer disposed adjacent to the first layer; and a display control unit configured to:

select the transparent display unit based on a determination that the vehicle is in a key on position;

and select the reflective display unit based on a determination that the vehicle is turned off.

10. The multilayer display according to claim 9, further comprising a cover layer applied to the first layer.

11. The multilayer display according to claim 9, wherein the display control unit is configured to cause the reflective display unit to display a dark background when the transparent display unit is selected.

12. The multilayer display according to claim 9, wherein the reflective display unit is a bi-stable display.

13. The multilayer display according to claim 9, wherein the display control unit is configured to activate a lighting element to illuminate the reflective display unit when the reflective display unit has been selected.

14. The multilayer display according to claim 9, further comprising an actuator, wherein the actuator is utilized to toggle between selection of the transparent display unit and the reflective display unit.

15. The multilayer display according to claim 9, wherein the transparent display unit comprises any of an Organic Light Emitting Diode (OLED) display, a Liquid Crystal Display (LCD), a Micro-LED display, and/or a Quantum Dot LED display.

16. The multilayer display according to claim 15, wherein the reflective display unit is a bi-stable, electronic ink (E-ink) display.

17. A method, comprising:

determining an amount of power available to a multilayer display associated with a vehicle, the multilayer display comprising a first layer comprising a transparent display unit, and a second layer comprising a reflective display unit; and selecting the transparent display unit based on a determination that the vehicle is in a key on position; or selecting the reflective display unit based on a determination that the vehicle is in an accessory mode or a determination that the vehicle is turned off.

18. The method according to claim 17, further comprising activating a lighting element on the vehicle to illuminate the reflective display unit when the reflective display unit has been selected.

19. The method according to claim 17, further comprising causing the reflective display unit to display a dark background when the transparent display unit is selected to enhance contrast of content displayed on the transparent display unit.

20. The method according to claim 17, further comprising changing content for display on the reflective display unit when the amount of power is available.

* * * * *